United States Patent [19]

Beveridge

[11] 4,044,916

[45] Aug. 30, 1977

[54] CONTAINERS HAVING PROTECTIVE OPENING EDGES

[75] Inventor: John Beveridge, Uxbridge, England

[73] Assignee: Metal Box Limited, England

[21] Appl. No.: 643,649

[22] Filed: Dec. 23, 1975

[51] Int. Cl.[2] ..... B65D 41/32

[52] U.S. Cl. ..... 220/270; 220/90.6

[58] Field of Search ..... 220/270–273, 220/90.6

[56] References Cited

U.S. PATENT DOCUMENTS

| | | | |
|---|---|---|---|
| 3,696,961 | 10/1972 | Holk, Jr. | 220/90.6 X |
| 3,809,283 | 5/1974 | Kehe | 220/270 |
| 3,856,179 | 10/1974 | Fox et al. | 220/270 |
| 3,891,116 | 6/1975 | Schane | 220/270 |

*Primary Examiner*—George T. Hall

*Attorney, Agent, or Firm*—Diller, Brown, Ramik & Wight

[57] ABSTRACT

Tear open cans having a band of plastics material adhered to the removable portion to mask the torn edge created on opening and either a guard bead formed in the body material or a fold in the remainder of the can end, to mask the torn edge remaining on the body after the removable portion is torn off.

5 Claims, 7 Drawing Figures

CONTAINERS HAVING PROTECTIVE OPENING EDGES

This invention relates to easy-opening containers, that is to say, to containers having tubular, e.g. cylindrical, bodies having an end closed by an easy-opening end closure. By easy-opening end closure is in turn meant a closure having a panel which is defined by a line of weakening and which may at least partially be torn away along the weakening line to leave a dispensing orifice.

When used for beverages easy-opening containers have tear-away panels which are small in relation to the end closures on which they are formed; for other applications, however, the removable panels may occupy a large proportion of the end closure area and are often called full aperture easy-opening ends. In both cases the torn edges left on either side of the weakening line when the panel is torn away tend to be sharp, and may therefore cause injury to the user or another person.

Various ways of masking the torn edges to prevent injury are known, such as those described in U.K. Pat. Specification No. 1398958 (Agent's Ref. 917) belonging to the Continental Can Company, in which Application a full aperture easy-opening end has a first band of hot melt adhesive is bonded to the chuck wall of the end closure so as to span the weakening line on the outside of the container and a second band of hot melt adhesive is similarly bonded to the removable panel so as to span the weakening line on the inside of the container. In this way both of the torn edges formed when the panel is torn away are masked, so reducing the risk of injury to the user.

According to the present invention there is provided a combination of a tubular body for the container and an easy-opening end closure seamed to one end of the body, the closure having a removable panel defined by a line of weakness, and a band bonded to the removable panel and arranged to span the line of weakness so as to mask the torn edge of the panel after removal of the panel from the closure, the combination further including means formed integrally from the material of the body or the closure and arranged to mask the torn edge of the remainder of the closure on removal of the removable panel thereof.

According to one embodiment, the band may be attached to the outside surface or inside surface of the removable panel; if however it is attached to the inner surface it is preferably flexible so that it may be pulled through the orifice created when the removable panel is torn away from the rest of the closure. In a preferred embodiment of the invention, a coating of a release agent is applied to that portion of the remainder over which the band lies so that the band, whilst bonded to the removable panel, is prevented from adhering to the remainder.

The means formed integrally from the material of the body or closure may be in the form of an annular fold formed in the closure material ajacent to the line of weakness or alternatively may be in the form of an inwardly directed bead formed in the tubular body material to extend radially inwards to mask the torn edge of the remainder of the closure after opening.

Two easy-opening containers embodying the invention will now be described, by way of example and with reference to the accompanying drawings, of which:

Figure 1:
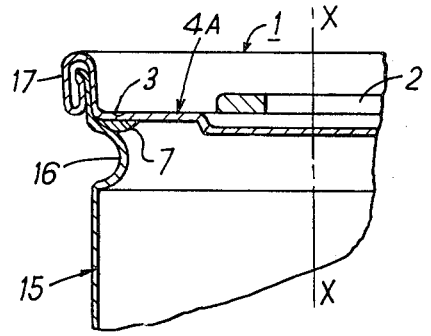
FIG. 1 is a central vertical section of the first container showing part of the container body and the attached part of the easy-opening end closure.
Figure 2:
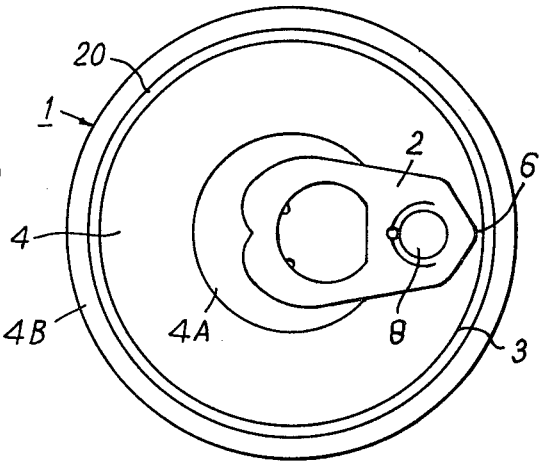
FIGS. 2 to 5 show the end closure of the container of FIG. 1 before seaming to the container body.
Figure 3:
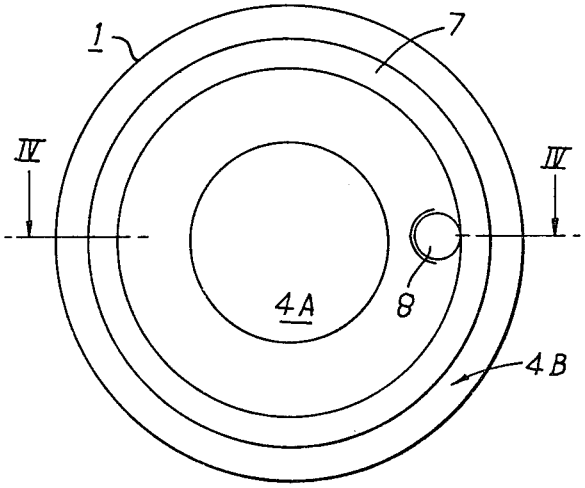
Figure 4:
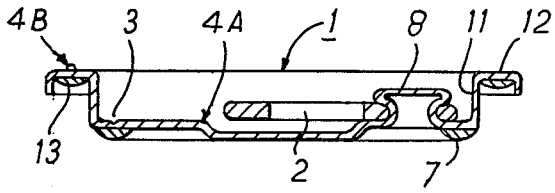
Figure 5:
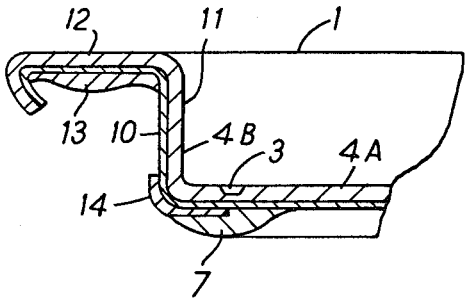

Individually, FIGS. 2 and 3 show the faces of the end closure of the container of FIG. 1 which are generally disposed on, respectively, the outside and the inside of the assembled container; FIG. 4 is a view of the end closure taken in section on the line IV—IV of FIG. 3 which its depth exaggerated for clarity; and FIG. 5 shows the left-hand side of the closure as seen in FIG. 4, enlarged to show detail which is not shown in FIGS. 2 to 4.

Referring now to FIG. 1, an easy-opening container has a tinplate or aluminium cylindrical body 15 which has a central longitudinal axis X—X and is closed at its ends by generally metal end closures attached by conventional double seams 17. Of the two end closures only the one at the top of the container is shown. It is of the easy-opening kind and accordingly has a panel 4A defined by a circular line of weakening 3 which enables the panel to be torn away be means of an attached pull tab 2. The detailed arrangement of this easy-opening end closure, generally denoted 1, will now become apparent from the following description to be given with reference to FIGS. 2 to 5.

From these figures, which show the end closure 1 before it is seamed on to the body 15, it will be understood that the closure is basically formed of a generally plane end closure panel 4, a chuck wall 11 upstanding from the panel 4, and a hooked seaming flange 12 extending peripherally around the panel 4 and joined thereto by the chuck wall 11. The seaming flange has a conventional flowed-in gasket 13 on the inside of the end closure 1, that is to say, the side of the end closure which form part of the interior surface of the assembled container; the flange then forms part of the double seam 17 (FIG. 1).

On the opposite side of the end closure, the outside of the latter, the panel 4 is formed with the line of weakening 3 by a circular score line. This weakening line 3 defines the tear-away panel 4A previously mentioned, the remainder of the closure being denoted 4B. The score line 3 is closely adjacent the base 20 of the chuck wall 11, so that the panel 4A occupies a very substantial proportion of the panel 4.

On the inside of the closure a flexible annular band 7 is bonded to the tear-away panel 4A adjacent the score line 3. The band has a width to span the score line 3 along the length of the latter. It is formed in situ by application as a fluid and is thereafter thermally cured. A suitable fluid would be plastisol, as described in British Pat. Specification No. 1280276.

In order to prevent possible interaction of the closure metal with the contents of the assembled container, the inside of the closure is coated with an overall base coating 10 of a cured vinyl lacquer. The band 7 is strongly adherent to this coating, so that after the application and curing, the band is firmly bonded to the tear-away panel 4A which it overlies along the length of the score line.

In order to prevent the band 7 from adhering to the non-removable portion 4B of the closure the part of the panel 4 lying radially outside the score line 3 is provided with a release coating 14 which is superimposed on the base coating 10. The release coating is of a material to which the material of the band 7 is poorly adherent. Typically the band 7 is of polyvinyl chloride, and the release coating is a printing ink to which the polyvinyl chloride will not stick, for example, ink number K.1573 from Ault and Wiborg Ltd. Further suitable materials for the band 7, the overall base coating 10 and the release coating 14 are disclosed in British Pat. No. 1398958, to which the reader's attention is directed.

Reverting again to FIG. 1, immediately beneath the end closure 1 in the interior of the container the container body 15 is formed with an inwardly projecting annular bead 16 of sufficient depth to extend radially some way beyond the score line 3.

In operation, a user requiring to open the container to gain access to its contents pulls on the pull tab 2 in a generally vertical arc (as seen in FIG. 1) so that the tab is moved to a generally axial orientation in relation to the container. This movement tilts the apical point 6 (FIG. 2) of the tab inwardly by pivotal movement about a transverse axis through the rivet 8 by which the tab 2 is attached, with the result that a small initial tear is formed along the neighbouring part of the score line 3. Direct axial force exerted on the tab then tears the panel 4A from the container to allow access to the container contents.

Figure 6:
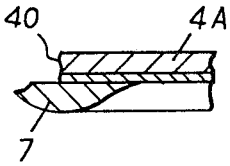
FIG. 6 shows a detail of the end closure of FIG. 1 during easy-opening operation thereof.

FIG. 6 shows how the peripheral edge 40 of the panel 4A after tearing away is masked by the flexible band 7. The danger of injury to the user or any other person is thereby reduced.

In addition to this masking of the panel 4A, the torn edge left on the containers, when the panel 4A is removed, is also masked, by means of the bead 16. The bead is sufficiently near to the panel 4 and of a sufficient radial depth to prevent any substantial risk of injury.

In various possible embodiments of the described arrangement, which may be used separately or in conjunction with one another: the bead 16 is discontinuous and so forms a series of spaced projections around the body 15; the band 7 is located on the outside of the end closure 1 rather than the inside thereof and may therefore be rigid instead of flexible; the base coating 10 is omitted and the band 7 is bonded to the plain metal of the end closure 1; the materials of the base coating 10 and the band 7 are such that the band will not adhere to the base coat, the release coating 14 is omitted and the band is bonded to the panel 4A by means of a coating of a material to which the band material is adherent and which is itself adherent to the base coating; and the band 7 is pre-formed rather than formed in situ.

Figure 7:
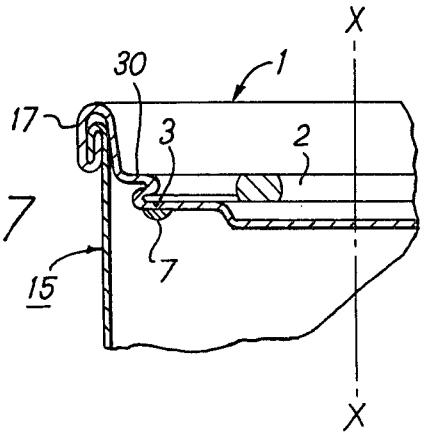
FIG. 7 is a view corresponding to FIG. 1 of the second container in accordance with the invention.

If desired, the masking of the torn edge left on an easy-opening container in accordance with the invention can be provided by a fold which is formed on the easy-opening end closure of the container so as to project radially inwardly beyond the weakening line around the closure. FIG. 7 shows such a possibility; in that figure the fold is denoted by the reference numeral 30.

It will be noticed that when the band 7 is applied to the inside of the can end, it serves as a further protection to the scored metal of the end closure additional to the overall coating.

We claim:

1. An easy opening container having a substantially tubular body and an easy-opening end closure seamed to one end of the body, the closure having a removable panel defined within a non-removable part of the closure by a line of weakness, wherein the improvement comprises a band bonded to the underside of the removal panel and arranged to span the weakening line and to underlie the non-removable part so as to mask the torn edge of the panel after removal of the panel from the closure, the combination further including a radially inwardly projecting fold formed integrally from the material of the closure and overlying said line of weakness to mask the torn edge of the said non-removable closure part on removal of the said removable panel.

2. An easy opening container comprising a tubular body and a closure secured to one end of said body by a seam, said closure including an end panel, said body having a circumferentially disposed continuous bead inwardly directed and underlying said end panel in closely spaced relation thereto, said closure being of the easy opening type and including a circumferential score formed in said end panel in overlying relation to said bead, said score dividing said end panel into a removable panel portion and a non-removable panel portion, said non-removable panel portion having an inner periphery overlying said bead, and a band bonded to said removable panel portion and extending across said score and overlapping said non-removable panel portion, at least a portion of said band being disposed between said bead and said non-removable panel portion, said band being arranged to mask the edge of said removable panel portion and said bead being arranged to mask the edge of the non-removable panel portion when said removable panel portion is removed.

3. The container of claim 2 wherein said band is flexible and releaseable from said non-removable panel portion.

4. The container of claim 3 wherein said band contacts said bead.

5. The container of claim 1 wherein said fold is axially spaced from said removable panel portion.

* * * * *